US007471805B2

(12) United States Patent
Goldberg

(10) Patent No.: US 7,471,805 B2
(45) Date of Patent: Dec. 30, 2008

(54) HEARING AID MECHANISM

(75) Inventor: Josh Goldberg, Santa Cruz, CA (US)

(73) Assignee: Central Coast Patent Agency, Inc., Watsonville, CA (US)

( * ) Notice: Subject to any disclaimer, the term of this patent is extended or adjusted under 35 U.S.C. 154(b) by 102 days.

(21) Appl. No.: 11/567,915

(22) Filed: Dec. 7, 2006

(65) Prior Publication Data

US 2007/0104344 A1 May 10, 2007

Related U.S. Application Data

(63) Continuation-in-part of application No. 11/282,335, filed on Nov. 18, 2005.

(60) Provisional application No. 60/748,721, filed on Dec. 8, 2005, provisional application No. 60/637,733, filed on Dec. 20, 2004.

(51) Int. Cl.
*H04R 1/02* (2006.01)
*H04R 25/00* (2006.01)

(52) U.S. Cl. ..... 381/415; 381/324

(58) Field of Classification Search ..... 381/396, 381/400, 401, 407, 413, 415
See application file for complete search history.

(56) References Cited

U.S. PATENT DOCUMENTS

| | | | | |
|---|---|---|---|---|
| 5,640,457 | A * | 6/1997 | Gnecco et al. | 381/322 |
| 5,987,146 | A * | 11/1999 | Pluvinage et al. | 381/381 |
| 6,654,476 | B1 * | 11/2003 | Guenther | 381/415 |
| 7,132,597 | B2 * | 11/2006 | Hosler | 84/723 |
| 2004/0184631 | A1 * | 9/2004 | Hosler | 381/415 |

* cited by examiner

*Primary Examiner*—Brian Ensey

(57) ABSTRACT

A hearing aid includes a sound input device, and a speaker, wherein the speaker includes a compartment with magnet suspended in a fluid containing magnetic particles and wherein a coil wrapped around the compartment or in close proximity thereto excites the magnet to vibrate causing pressure waves to vibrate a diaphragm proximal to the magnet.

19 Claims, 5 Drawing Sheets

HEARING AID MECHANISM

CROSS-REFERENCE TO RELATED APPLICATIONS

The present invention is a continuation in part to a U.S. patent application Ser. No. 11/282,335, filed on Nov. 18, 2005, which claims priority to a U.S. provisional patent application, Ser. No. 60/637,733, filed on Dec. 20, 2004. The present application also claims priority to provisional patent application Ser. No. 60/748,721, filed on Dec. 8, 2005. All of the specifications or the above mentioned priority claims are included herein at least by reference.

BACKGROUND OF THE INVENTION

1. Field of the Invention

The present invention is in the field of sound devices including speakers and pertains particularly to those devices used in such as hearing aid devices.

2. Discussion of the State of the Art

The modern art of hearing aid construction has been based upon the standard use of a balanced armature in the speaker component of the hearing aid for the past 50 years. A balanced armature is typically a metal strip aligned between poles of a cylindrical magnet. The armature is attached to a diaphragm in state-of-art hearing aid speakers. Vibration of the armature caused by magnetic field manipulation via current variations in the coil from an audio source or via microphone output current is transferred to a diaphragm to produce the amplified sound that the user hears.

Typical hearing aids take several different designs and general form factors including a "behind-the-ear" (BTE) form factor worn behind the ear whereby the sound vibrations are carried into the ear to an ear mold through a plastic tube. Another form is an "in-the-ear" or (ITE) form factor. Another form factor is "in-the-canal" (ITC) and still another form factor is "completely in the canal" (CIC). The smaller designs are generally less powerful and have fewer features than do the larger devices like the BTE design.

Likewise, there are other technologies used in state-of-art hearing aid systems for noise dampening and noise cancellation. Some of these involve digital signal processing, while others are more of a mechanical nature like using a ferrofluid to dampen the motion of the armature is an armature-based speaker device for a hearing aid. One problem with current devices is that the armature is extremely fragile and may be damaged or knocked out of proper alignment.

Therefore, what is clearly needed is a speaker device for a hearing aid that eliminates the need for a fragile armature and that provides better vibration with more dampening using a less complex architecture.

SUMMARY OF THE INVENTION

A hearing aid is provided. The hearing aid includes a sound input device, and a speaker. In a preferred embodiment, the speaker includes a compartment with magnet suspended in a fluid containing magnetic particles and wherein a coil wrapped around the compartment or in close proximity thereto excites the magnet to vibrate causing pressure waves to vibrate a diaphragm proximal to the magnet.

In one embodiment, the form factor of the hearing aid is a behind-the-ear (BTE) device. In another embodiment, the form factor of the hearing aid is an in-the-ear (ITE) device. In another embodiment, the form factor of the hearing aid is an in-the-canal (ITC) device. In another embodiment, the form factor of the hearing aid is a completely-in-the-canal (CIC) device.

In one embodiment, the sound input device is a microphone. In one embodiment, the sound input device is a telecoil. In one aspect, the hearing aid further includes an amplifier connected in between the sound input device and the speaker. In one embodiment, the fluid containing the magnetic particles is a ferrofluid. In one embodiment, the diaphragm is a ferrous metal composite.

According to another aspect of the invention, in a hearing aid, a method for aiding hearing is provided. The method includes the acts (a) capturing sound with a sound input device integral to the hearing aid and converting the sound into a sound signal, (b) amplifying the sound signal and feeding the signal onto a coil, (c) exciting a magnet suspended in a fluid containing magnetic particles to vibrate, and (d) reproducing the vibrations of the magnet at a diaphragm having contact with the fluid.

In one aspect of the method, the input device is a microphone. In another aspect, the input device is a telecoil. In one aspect of the method, in act (c), excitation of the magnet is accomplished by voltage carried through the coil. In this aspect, the fluid is ferrofluid. In one aspect, of the method in act (d), the diaphragm is a ferrous metal.

In one aspect, a further act (e) is provided to carry the vibrations from the diaphragm over a tube to a resonator placed in the ear. In a variation of this aspect, the resonator is a second diaphragm encased in an ear piece. In another variation of this aspect, the resonator is the ear piece. In one aspect in act (c), the magnetic particles are ferrous particles.

BRIEF DESCRIPTION OF THE DRAWING FIGURES

FIG. 1*a* is a sectioned elevation view of a speaker used in an embodiment of the present invention.

FIG. 1*b* is a plan view of the speaker of FIG. 1*a*.

DETAILED DESCRIPTION

Figure 1A:
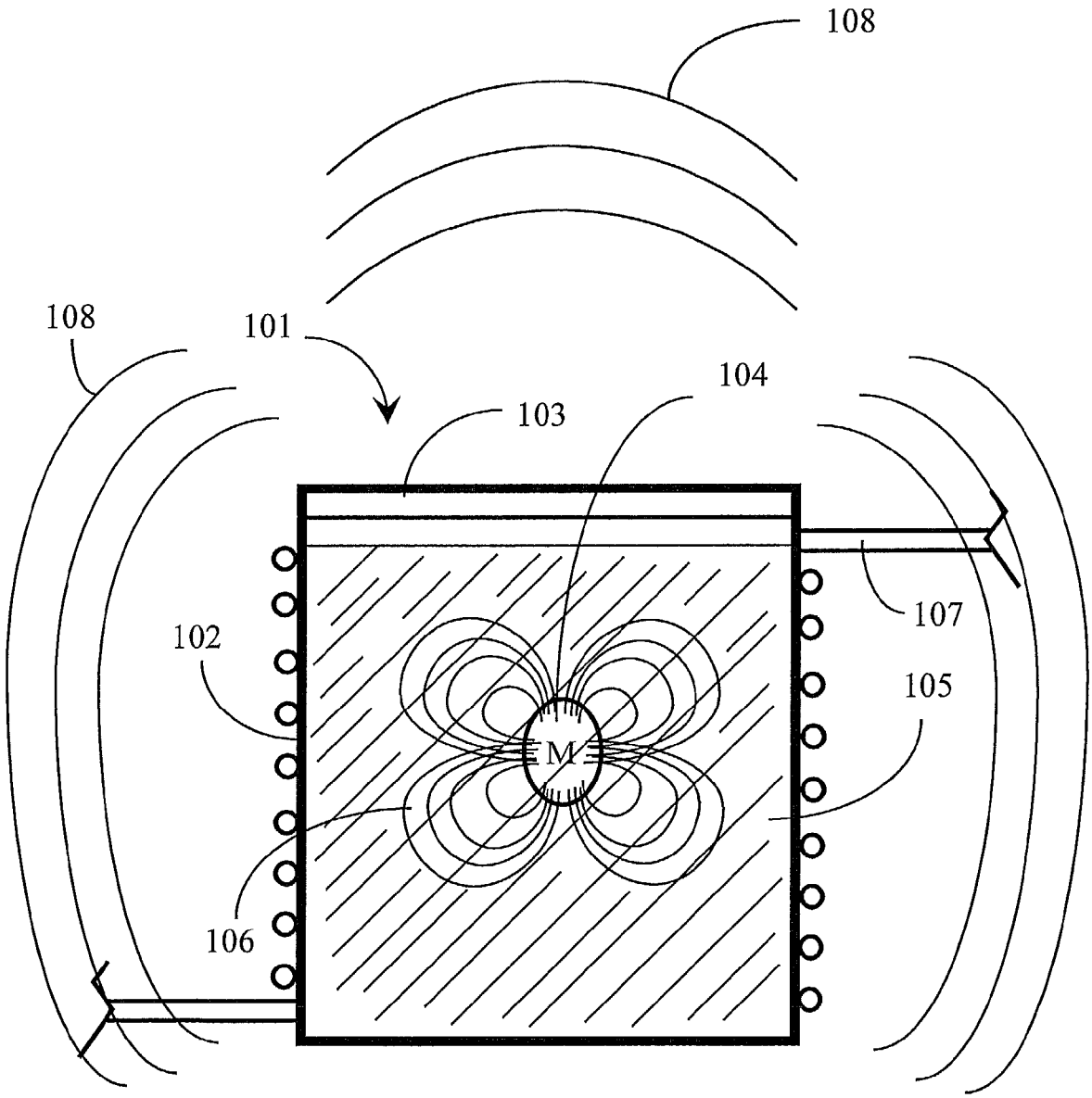
Figure 1B:
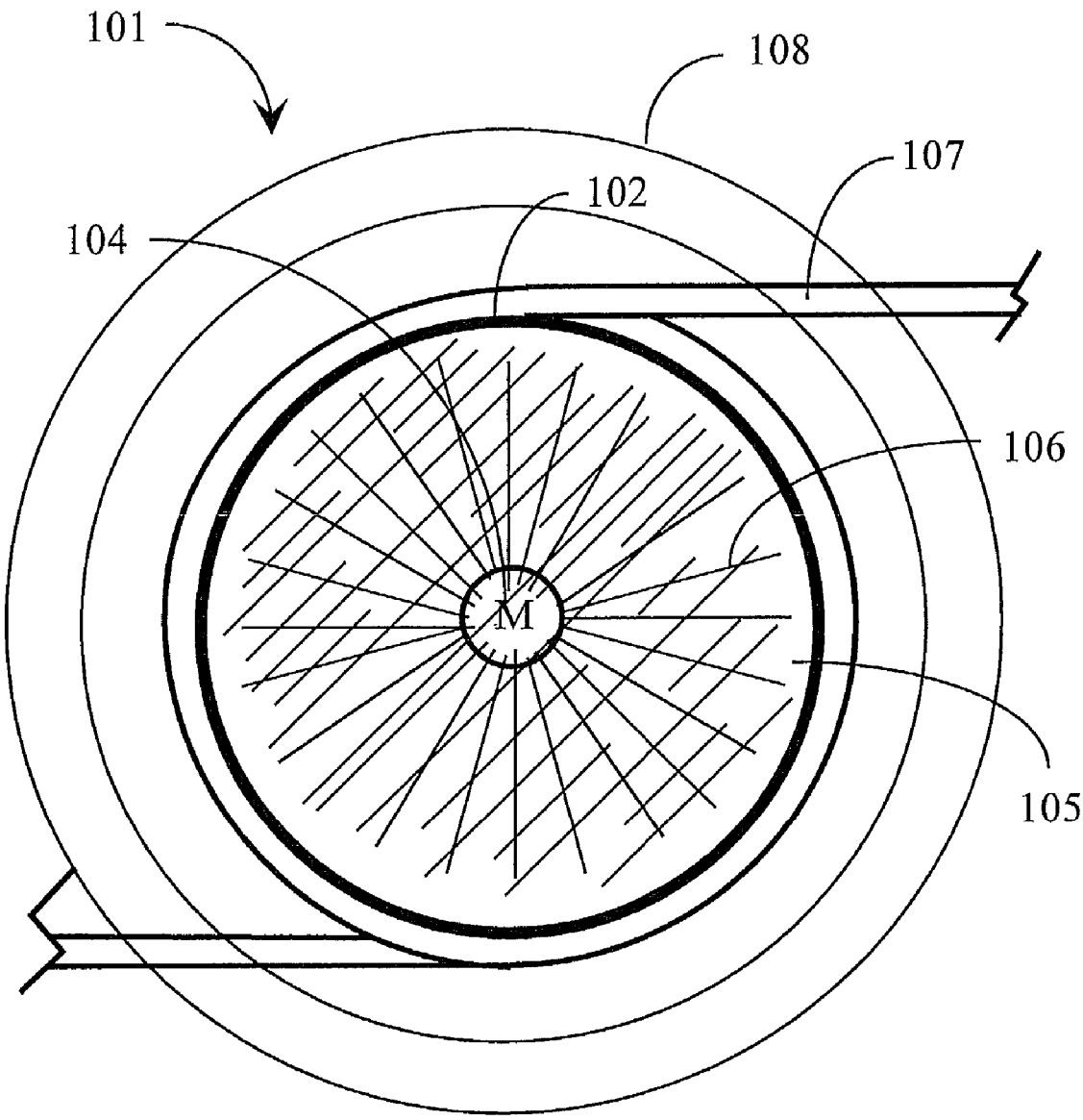

FIGS. 1*a* and 1*b* show an elevation view and a plan view respectively of a speaker 101 used in a preferred embodiment of the present invention. Speaker 101 in this embodiment includes an outer container 102. Container 102 may be a polymer container, or a container provided of some other durable material. The container in this example has a lid 103 which may be removed to fill the container at least partially with a ferrofluid 105. In a preferred embodiment of the present invention, lid 103 may function as a speaker diaphragm. A ferrofluid is a stable colloidal suspension of subdomain magnetic particles in a liquid or semi-liquid carrier. The particles, which in one embodiment have an average size of about 100 Å (10 nm), may be coated with a stabilizing dispersing agent (surface-acting, or surfactant), which prevents particle agglomeration even when a strong magnetic field gradient is applied to the ferrofluid. In the absence of a magnetic field, the magnetic moments of the particles are randomly distributed and the fluid typically has no net magnetization.

An unanchored permanent magnet 104, labeled M is suspended in the ferrofluid as a primary force generator. The permanent magnet in this embodiment is freely suspended inside container 102 that contains the ferrofluid 105 that provides dampening and force transmission. Lines of magnetic force 106 related to the permanent magnet cause the permanent magnet to be suspended in the ferrofluid.

A coil 107, in this case of electrically conductive metal, for transmitting an audio signal from a source, is wound about container 102 in this example to complete the speaker construction. The coil acts as an excitation apparatus in one embodiment for the permanent magnet in proximity of the container 102. The coil may, in some embodiments be encapsulated in the container walls, may be adhered to the container in different ways, or may be situated separately from the container such that the coil is not subject to forces acting on the container walls. In some embodiments there may be multiple coils arranged in different geometry for various purposes. In one embodiment, coil 107 may be a "telecoil" also referred to as a T-Coil or T-Switch used in hearing aid applications. A telecoil is a tiny coil wrapped around a core, in this case, a magnet suspended in the ferrofluid. The telecoil can hear a magnetic signal that represents sound. In this application, coil 107 is a tiny coil of wire wrapped around container 102. If coil 107 is a telecoil, it will induce an electric current when it is in the presence of a changing magnetic field.

The varying field from the coil vibrates the magnet, which transmits-movement by force across the essentially incompressible ferrofluid to walls and diaphragm 103 of container 102. The container walls and diaphragm act as a sound resonator and amplifier, causing pressure perturbations in the surrounding air, indicated in FIGS. 1*a* and 1*b* by pressure lines 108.

It is not required that the container, such as container 102 in this example, be of the shape of a cylinder, as shown. In some embodiments the container may be spherical, or egg-shaped, or may have some other shape depending on aesthetic or acoustical considerations for hearing aid design. The container may also be made of any one or a combination of different materials, including, but not limited to plastic, metal or other durable materials.

Magnet strength may be chosen in coordination with the viscosity of the ferrofluid, particle size in ferrofluid, saturation magnetization, and volume of ferrofluid used, as well as in concert with other considerations. Due to various properties of ferrofluids in reaction to the field of the permanent magnet, the fluid gathers into a substantially spherical shape around the core magnet that is placed inside the container. The number of coils should be sufficient to generate a substantial force on the magnet/fluid system and a standard impedance value for audio output for hearing aids may be preferred. The leads of the coil should be attached to an appropriate audio source such as a microphone for the rest of the construction parameters chosen.

To enhance the sound quality and ensure that the primary drive magnet stays floating or suspended in the ferrofluid, magnets of significantly lesser strength may be placed in opposite polarity to the primary magnet at the ends of the drive cylinder.

In a working model to prove the concept, a fragment of a permanent magnet from a computer hard drive was used, and was suspended in a volume of approx. 25 ml of ferrofluid in a plastic prescription pill bottle. The model may be reproduced in miniature for application as a hearing aid speaker. The ferrofluid used in this particular model exhibited the following properties:

Ferrotec EFH1
- Medium—Light Mineral Oil
- Saturation Magnetization—400 Gauss
- Density—1.21 gm/ml
- Viscosity—6 centipoise (cp) @ 27° C.
- Surface Tension—29 dynes/cm A much smaller volume of ferrofluid and a much smaller size of magnet would be required to accomplish a hearing aid speaker depending on the scope of the device, whether it is a BTE, an ITE, an ITC, or a CIC. The ferrofluid speaker with attached diaphragm may be produced according to different designs of hearing aids using various features.

Figure 2:
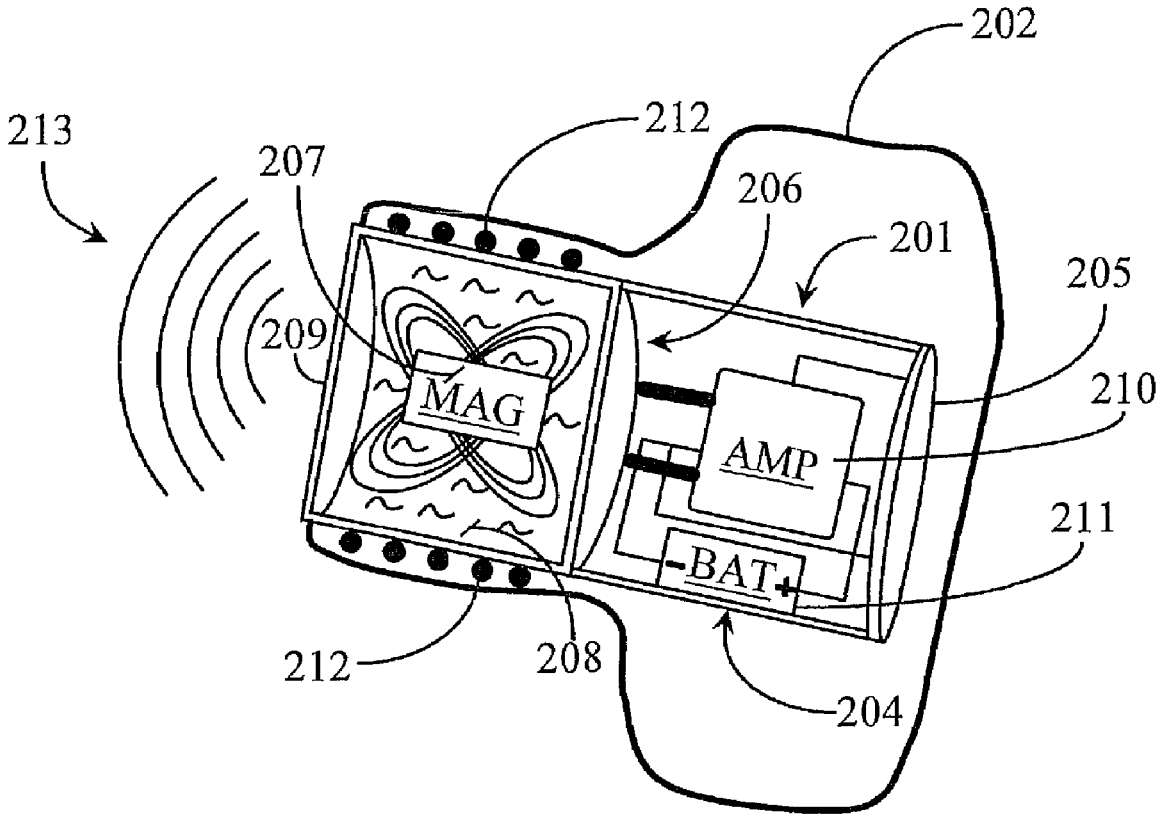
FIG. 2 is a sectioned view of a hearing aid illustrating internal components according to an embodiment of the present invention.

FIG. 2 is a sectioned view of a hearing aid 200 illustrating internal components according to an embodiment of the present invention. Hearing aid 200 is an ITE hearing aid comprising an enclosure 201 encased in an ear mold 202. Ear mold 202 represented logically in this example by a bold boundary line, may be manufactured of a semi-durable polymer or other appropriate materials that retain durability, yet provide the user with a comfortable fit. In one embodiment, ear mold 202 may be customized in molding to fit a wearer's ear. A section of ear mold 202 is removed in this example to reveal enclosure 201. A section of enclosure 201 is removed in this example to reveal the internal components of hearing aid 200.

Enclosure 201 contains the components of hearing aid 200. Enclosure 201 is, in this example, a cylindrical housing that is sectioned into two separate compartments. A compartment 204 encloses the electronic components of hearing aid 200. A compartment 206 encloses the speaker components of hearing aid 200. Compartment 204 supports a microphone 205 positioned strategically at one end of device 200. Microphone 205 functions to capture sound and convert the captured sound into a varying electronic signal representing the captured sound. In one embodiment, microphone 205 may be a directional microphone. The surface of microphone 205 is exposed through ear mold 202 to enable sound capsule.

Compartment 204 includes an amplifier (AMP) and associated circuitry. Amplifier 210 produced an amplified signal based on the input signal received from microphone 205 while device 200 is on and active as a hearing aid. Compartment 204 contains a battery (BAT) 211 to provide power to the microphone and amplifier. A switch (not illustrated here) may be provided for powering hearing aid 200 on or off.

Compartment 206 is, in a preferred embodiment, an airtight compartment containing an amount of ferrofluid 208. The exact amount and viscosity of fluid 208 may depend on design considerations for the hearing aid type. A magnet 207 is provided within compartment 206 and maintains a state of suspension within ferrofluid 208. Ferrofluid 208 is analogous to fluid 105 described further above although some properties of the fluid may vary form that of other applications without departing from the spirit and scope of the present invention. Magnet 207 is analogous to magnet 104 described further above. The exact size and shape of magnet 207 may vary accordingly with the design of the hearing aid.

One end of compartment 206 is a diaphragm 209. In this example, diaphragm 209 is ferrous in nature and is able to vibrate in reaction to any pressure variances acting against it that are translated through the ferrofluid from magnet vibration as described further above with respect to speaker 101. In this example, magnetic force lines are illustrated to exemplify a magnetic field surrounding magnet 207. A coil wrap 212 is provided around the periphery of compartment 206 to provide a source of excitation to magnet 207 in order to produce the required vibrations for producing amplified sound vial diaphragm 209. In one embodiment, coil 212 is connected only to amplifier 210 and is dedicated to carry the varying voltage around suspended magnet 207 in order to produce the required vibration in the magnet by acting on the magnetic field of the magnet.

In one embodiment of the present invention, coil wrap 212 may be a T-Coil, also referred to in the art as a telecoil or a T-switch. In this case, coil 212 may function as an input device in place of or in conjunction with microphone 205. Therefore, microphone 205 may be disabled and coil 207 then enabled to detect magnetic signals given off by such as telephones, or other like sound producing devices. In the case of a telecoil, hearing aid 200 may enhance healing by focusing only on the magnetic signal source instead of receiving background noise via microphone 205.

In general use of the invention, pressure waves created by sound act on microphone 205 causing vibration and conversion of the vibrations into an electronic voltage signal using associated circuitry. The generated signal is fed into amplifier 210 as a reference signal. Amplifier 210 generates a much stronger voltage signal based exactly on the variations of the original signal produced by the microphone.

The output of amplifier 210 is carried through coil 212 and causes suspended magnet 207 to vibrate while suspended in ferrofluid 208. Those vibrations are replica of the signal variations in coil 212. As magnet 207 vibrates, pressure waves are created within the ferrofluid and act radially against the walls of compartment 206 including diaphragm 209. Diaphragm 209 vibrates accordingly and in turn creates pressure waves 213 representing amplified sound that the user hears and interprets as sound. In one embodiment, diaphragm 209 is a ferrous metal that retains excellent vibration capabilities. In another embodiment, other materials may be used as long as vibration properties are not compromised by material choice.

Diaphragm 209 maybe permanently attached to enclosure 201 to from a sealed end that prevents any ferrofluid from leaking out. In one embodiment, a mechanism may be provided, such as a one way valve (not illustrated), to enable modification of ferrofluid amount, viscosity or other properties. It is also noted herein that the materials of compartment 206 other than diaphragm 209 may be chosen in part based on vibration dampening properties so that some noise cancellation may be provided by the speaker architecture.

Figure 3:
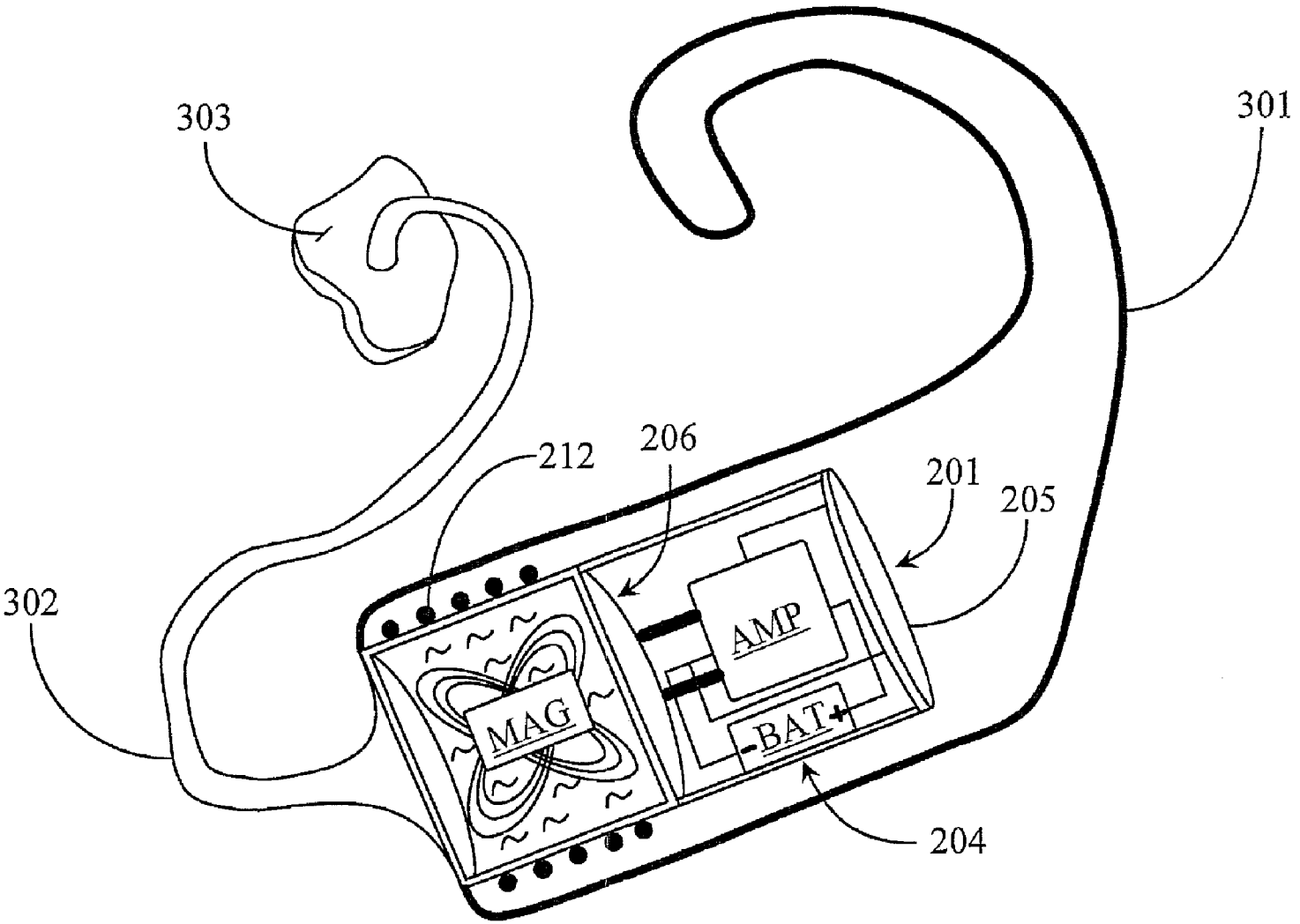
FIG. 3 is a sectioned view of a hearing aid illustrating internal components according to an according to another embodiment of the present invention.

FIG. 3 is a sectioned view of a hearing aid 300 illustrating internal components according to an according to another embodiment of the present invention. Healing aid 300 is constructed as a BTE hearing aid that is worn behind a user's ear. In this embodiment, a polymer molded ear piece 301 is provided to enclose the hearing aid component housing 201. It is noted herein that many of the elements described with respect to the example of FIG. 2 are also present in this example and are functionally unchanged in this embodiment. Therefore, such elements will not be re-introduced.

Ear piece 301 has a section removed to reveal enclosure 201, which also has a section removed to reveal compartments 204 and 206 and the internal components of hearing aid 300. It is noted herein that the components that make up hearing aid 300 may be larger than those already described because there is no restriction of being able to fit the component into a user's ear. Likewise batteries may be larger and more features may be added.

In this example of a BTE hearing aid, a plastic tubing 302 is attached to diaphragm 209 in a way as to receive vibrations from diaphragm 209 and translate those vibrations through the tubing structure to an ear mold 303 that is placed inside the user's ear. In this case, ear mold 303 vibrates according to the vibration caused to the diaphragm and functions as a sound resonator causing pressure waves that the user interoperates as sound.

Tubing 302 has a conical shaped end that attaches to the diaphragm to maximize translation of vibrations through the tubing structure. The means of attachment may be glue or, in some cases a flanged connection might be used. Tubing 302 is provided in a flexible polymer or some other material that is flexible yet provides the vibration transference required to enable the ear mold 303 to produce the sound. In one embodiment, the ear mold contains a vibrating resonator enclosed therein and functions only as a fitting for placing in the ear. In that case, the small end of tubing 302 would be directly attached to the second diaphragm or resonator.

It will be apparent to one with skill in the art that the ferrofluid speaker may be provided of the appropriate dimensions and materials for incorporation into all of the known from factors of hearing aids including ITE and BTE exemplified herein and the others, particularly ITC and CIC form factors. It will also be apparent to the skilled artisan that features like t-coil implementation, noise reduction circuitry, material noise dampeners, directional microphones, and other capabilities may be incorporated into the hearing aid of the present invention without departing from the spirit and scope of the invention.

Figure 4:
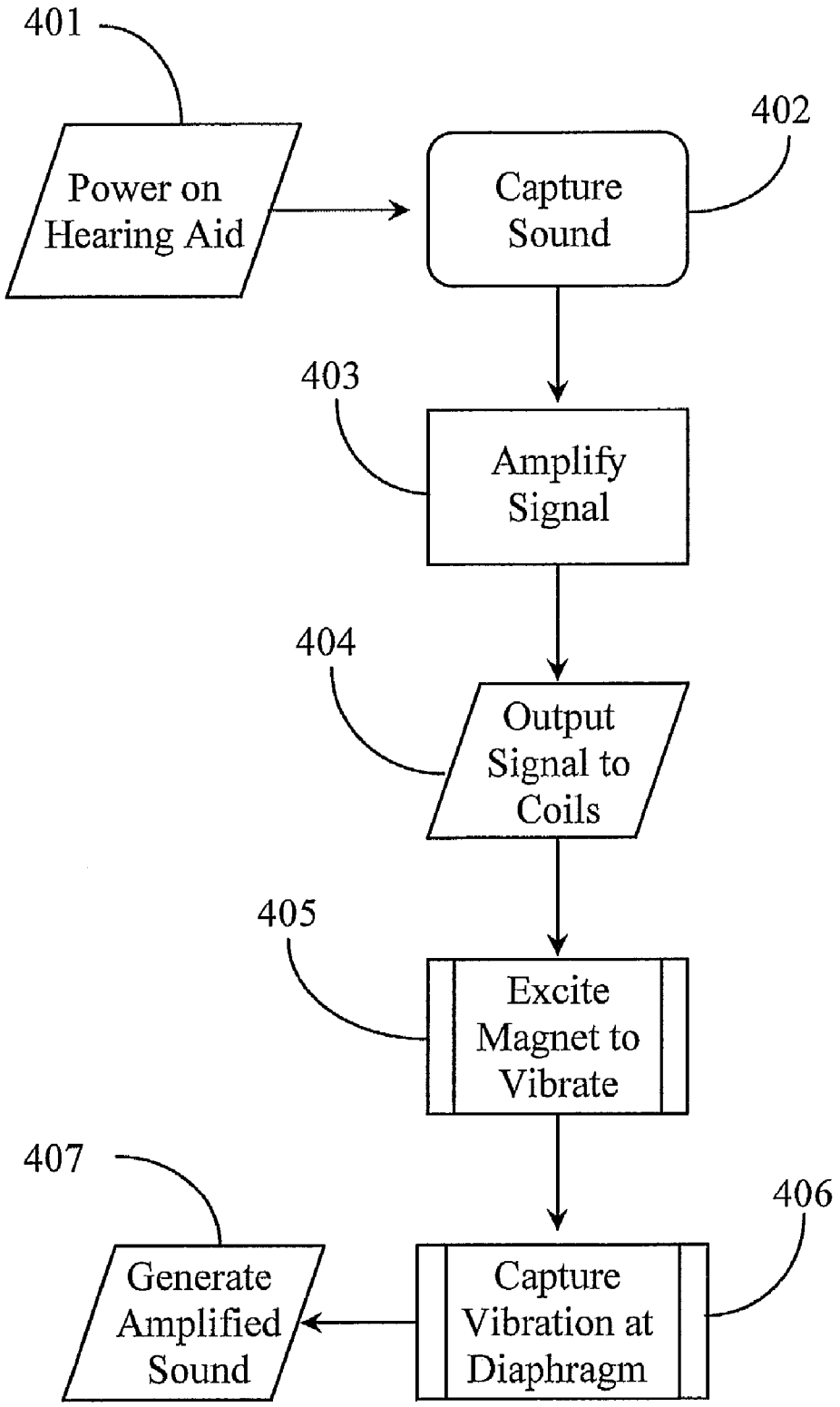
FIG. 4 is a process flow chart illustrating acts for enhancing hearing using the hearing aid of the present invention.

FIG. 4 is a process flow chart illustrating acts 400 for aiding hearing using the hearing aid of the present invention. In act 401, a user powers on a hearing aid analogous to hearing aid 200 of FIG. 2 or hearing aid 300 of FIG. 3. In act 402, the hearing aid captures sound with the aid of a microphone, or in one embodiment, a telecoil. The captured sound is fed into an amplifier, which amplifies the signal in act 403.

Output from the amplifier is carried over a coil analogous to coil wrap 212 of FIG. 2. The signal in the coil causes magnetic field fluctuation in the magnet field around a magnet suspended in ferrofluid analogous to magnet 207 of FIG. 2 exciting the magnet to vibrate in act 405. When the magnet vibrates, pressure waves are created within the ferrofluid and those pressure waves cause a diaphragm analogous to diaphragm 209 of FIG. 2 to vibrate in act 406. At act 407 the vibrations generated are interpreted by the user as amplified sound.

In one embodiment of the invention where a BTE hearing aid is used, then another act for carrying the vibrations from the diaphragm along a tube to an ear mold resonator may be inserted in acts 400 before act 407. One with skill in the art will recognize that there may be other sub-routines related to the general process of acts 400 included without departing from the spirit and scope of the invention such as acts or routines for noise cancellation, vibration dampening and the like. In still another embodiment, in act 402, a telecoil may be used to capture sound instead of a microphone. In this case, the telecoil captures magnetic signals from a device like a cell phone for example. In this case, the captured signal may or may not be amplified at the point of the hearing aid.

The method and apparatus of the present invention may be presented in the form factor of known hearing aid devices such as ITE and BTE devices. The method and apparatus of the invention should be afforded the broadest possible consideration under examination. The spirit and scope of the present invention is limited only be the claims presented for examination.

What is claimed is:

1. A hearing aid comprising:

a sound input device; and a speaker;

wherein the speaker includes a compartment with a magnet freely suspended in a fluid containing magnetic particles and wherein a coil wrapped around the compartment excites the magnet to vibrate causing pressure waves to vibrate a diaphragm proximal to the magnet.

2. The hearing aid of claim 1 having a form factor of a behind-the-ear (BTE) device.

3. The hearing aid of claim 1 having a form factor of an in-the-ear (ITE) device.

4. The hearing aid of claim 1 having a form factor of an in-the-canal (ITC) device.

5. The hearing aid of claim 1 having a form factor of a completely-in-the-canal (CIC) device.

6. The hearing aid of claim 1, wherein the sound input device is a microphone.

7. The hearing aid of claim 1, wherein the sound input device is a telecoil.

8. The hearing aid of claim 1, further including:

an amplifier connected in between the sound input device and the speaker.

9. The hearing aid of claim 1, wherein the fluid containing the magnetic particles is a ferrofluid.

10. The hearing aid of claim 1, wherein the diaphragm is a ferrous metal composite.

11. In a hearing aid, a method for aiding hearing comprising the steps of:

(a) capturing sound with a sound input device integral to the hearing aid and converting the sound into a sound signal;

(b) amplifying the sound signal and feeding the signal onto a coil;

(c) exciting a magnet freely suspended in a fluid containing magnetic particles to vibrate; and (d) reproducing the vibrations of the magnet at a diaphragm having contact with the fluid.

12. The method of claim 11, wherein in step (a), the input device is a microphone.

13. The method of claim 11, wherein in step (a), the input device is a telecoil.

14. The method of claim 11, wherein in step (c), excitation of the magnet is accomplished by voltage carried through the coil.

15. The method of claim 11, wherein in step (c), the fluid is ferrofluid.

16. The method of claim 11, wherein in step (d), the diaphragm is a ferrous metal.

17. The method of claim 11, wherein a further step (e), is provided to carry the vibrations from the diaphragm over a tube to a resonator placed in the ear.

18. The method of claim 17, wherein the resonator is the ear piece.

19. The method of claim 15, wherein, in step (c), the magnetic particles are ferrous particles.

* * * * *